US008115611B2

(12) United States Patent
Ozaki

(10) Patent No.: US 8,115,611 B2
(45) Date of Patent: Feb. 14, 2012

(54) VEHICLE-INSTALLED OBSTACLE DETECTING SYSTEM AND METHOD USING IMAGE CAPTURING AND SCANNING

(75) Inventor: Osamu Ozaki, Tagata-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 297 days.

(21) Appl. No.: 12/312,029

(22) PCT Filed: Dec. 21, 2007

(86) PCT No.: PCT/IB2007/004273

§ 371 (c)(1),
(2), (4) Date: Apr. 23, 2009

(87) PCT Pub. No.: WO2008/081323

PCT Pub. Date: Jul. 10, 2008

(65) Prior Publication Data

US 2009/0322502 A1 Dec. 31, 2009

(30) Foreign Application Priority Data

Dec. 27, 2006 (JP) ..... 2006-352750

(51) Int. Cl.
*G08B 21/00* (2006.01)

(52) U.S. Cl. ..... 340/435; 701/301; 382/104; 348/148

(58) Field of Classification Search ..... 340/435, 340/436, 903; 701/1, 301; 348/148; 382/104, 382/106

See application file for complete search history.

(56) References Cited

U.S. PATENT DOCUMENTS

2003/0093220 A1* 5/2003 Andersson et al. ..... 701/207

FOREIGN PATENT DOCUMENTS

| | | |
|---|---|---|
| EP | 1 302 747 A1 | 4/2003 |
| JP | A-09-069162 | 3/1997 |
| JP | A-2001-018717 | 1/2001 |
| JP | A-2002-099997 | 4/2002 |
| JP | A-2002-123818 | 4/2002 |
| JP | A-2006-018751 | 1/2006 |
| JP | A-2006-163879 | 6/2006 |

* cited by examiner

*Primary Examiner* — Jeffery Hofsass
(74) *Attorney, Agent, or Firm* — Oliff & Berridge, PLC

(57) ABSTRACT

An object detecting device scans an image captured by a camera from one side close to the vehicle to the other side remote from the vehicle for detection of an obstacle through pattern matching, so that an obstacle that is close to the vehicle and is likely to collide with the vehicle can be detected in a short time. Thus, the driver is informed of the presence of an obstacle having a high risk of collision, earlier than other obstacles located ahead of the vehicle.

10 Claims, 10 Drawing Sheets

FIG. 2

| NORTH LATITUDE | EAST LONGITUDE | COUNTRY (REGION) | RUNNING DIRECTION |
|---|---|---|---|
| AAA° | BBB° | JAPAN | LEFT-HAND TRAFFIC |
| CCC° | DDD° | JAPAN | LEFT-HAND TRAFFIC |
| ... | ... | ... | ... |
| UUU° | XXX° | U.S. | RIGHT-HAND TRAFFIC |
| YYY° | ZZZ° | U.S. | RIGHT-HAND TRAFFIC |

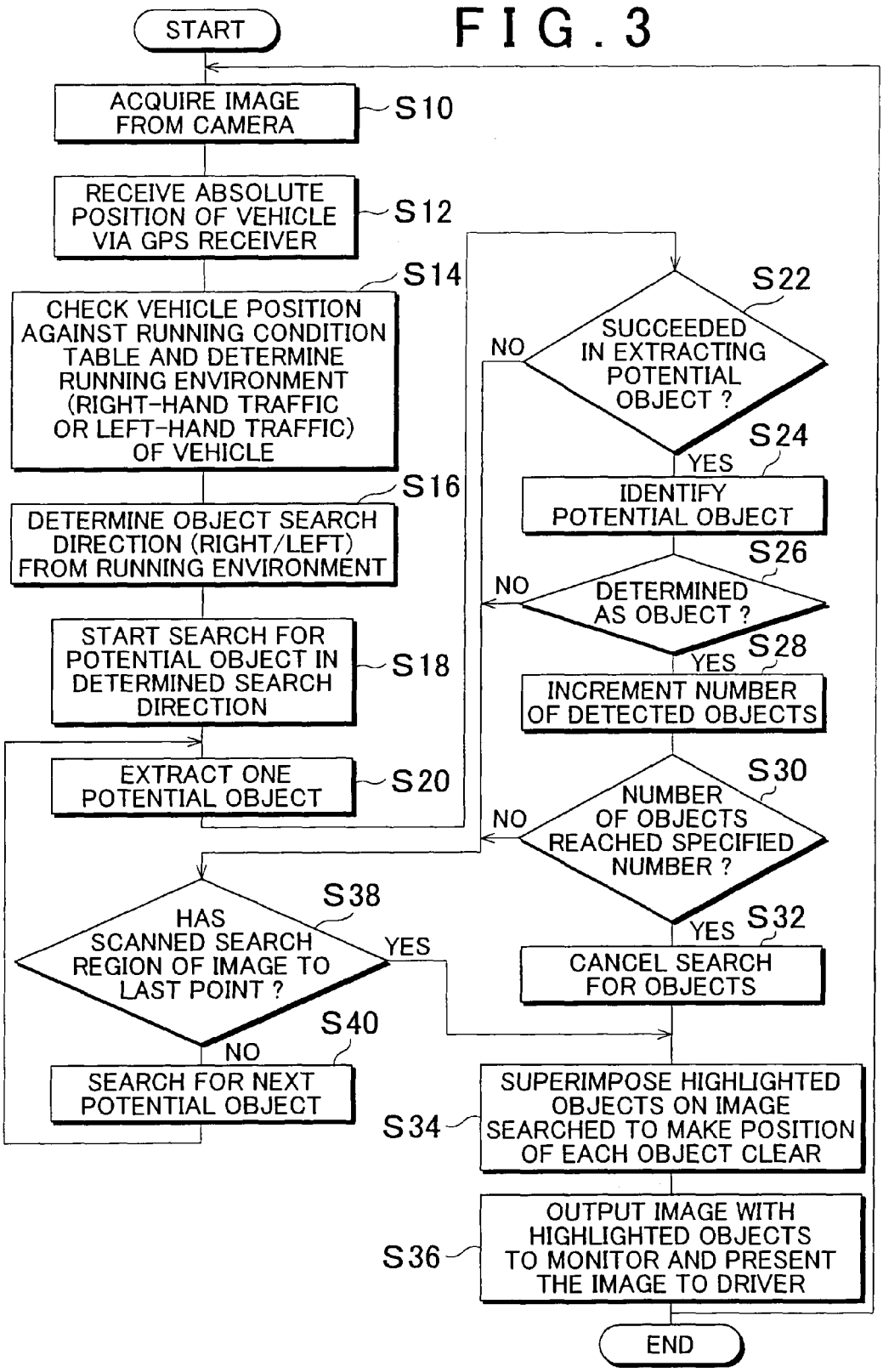
FIG. 3
START
ACQUIRE IMAGE FROM CAMERA
S10
RECEIVE ABSOLUTE POSITION OF VEHICLE VIA GPS RECEIVER
S12
CHECK VEHICLE POSITION AGAINST RUNNING CONDITION TABLE AND DETERMINE RUNNING ENVIRONMENT (RIGHT-HAND TRAFFIC OR LEFT-HAND TRAFFIC) OF VEHICLE
S14
DETERMINE OBJECT SEARCH DIRECTION (RIGHT/LEFT) FROM RUNNING ENVIRONMENT
S16
START SEARCH FOR POTENTIAL OBJECT IN DETERMINED SEARCH DIRECTION
S18
EXTRACT ONE POTENTIAL OBJECT
S20
SUCCEEDED IN EXTRACTING POTENTIAL OBJECT ?
S22
NO
YES
IDENTIFY POTENTIAL OBJECT
S24
DETERMINED AS OBJECT ?
S26
NO
YES
INCREMENT NUMBER OF DETECTED OBJECTS
S28
NUMBER OF OBJECTS REACHED SPECIFIED NUMBER ?
S30
NO
YES
CANCEL SEARCH FOR OBJECTS
S32
HAS SCANNED SEARCH REGION OF IMAGE TO LAST POINT ?
S38
YES
NO
SEARCH FOR NEXT POTENTIAL OBJECT
S40
SUPERIMPOSE HIGHLIGHTED OBJECTS ON IMAGE SEARCHED TO MAKE POSITION OF EACH OBJECT CLEAR
S34
OUTPUT IMAGE WITH HIGHLIGHTED OBJECTS TO MONITOR AND PRESENT THE IMAGE TO DRIVER
S36
END

FIG. 9

| VEHICLE SPEED | SPECIFIED NUMBER |
|---|---|
| <10Km/h | ∞ (e.g., 255) |
| ≥10Km/h, AND <50Km/h | 4 |
| ≥50Km/h, AND <80Km/h | 3 |
| ≥80Km/h, AND <100Km/h | 2 |
| ≥100Km/h | 1 |

VEHICLE-INSTALLED OBSTACLE DETECTING SYSTEM AND METHOD USING IMAGE CAPTURING AND SCANNING

BACKGROUND OF THE INVENTION

1. Field of the Invention

The invention relates to vehicle-installed obstacle detecting system and method, and more particularly to vehicle-installed obstacle detecting system and method for detecting obstacles in surroundings of the vehicle through pattern matching.

2. Description of the Related Art

Vehicle-installed obstacle detecting systems have been proposed which are arranged to detect pedestrians through pattern matching. For example, a moving object detecting system as disclosed in Japanese Patent Application Publication No. 2002-99997 (JP-A-2002-99997) specifies a road region based on image information received from a CCD camera, and combines the road region information with infrared image information received from an infrared camera so as to search for and specify a pedestrian or pedestrians within the road region through template matching. Thus, the moving object detecting system detects a pedestrian on a screen within the required minimum search range, assuring enhanced speed of processing for specifying the pedestrian.

With the above-described technology, however, detection of a pedestrian having a high possibility of colliding with the vehicle after a short time may be delayed depending on the circumstances.

SUMMARY OF THE INVENTION

It is an object of the invention to provide a vehicle-installed obstacle detecting system that is able to detect an obstacle having a high possibility of colliding with the vehicle, within a shorter period of time.

According to one aspect of the invention, there is provided a vehicle-installed obstacle detecting system for detecting an obstacle in surroundings of a vehicle, which includes: image capturing means for capturing an image of the surroundings of the vehicle, and detecting means for scanning the image captured by the image capturing means from one side of the image close to the vehicle toward the other side thereof remote from the vehicle, for detection of an obstacle through pattern matching.

In a system of the related art, a captured image is scanned from the upper side (remote from the vehicle) toward the lower side (close to the vehicle) on the image, and therefore, detection of an obstacle having a high possibility of colliding with the vehicle after a short time may be delayed. In the system constructed according to the first aspect of the invention, on the other hand, the detecting means scans the image captured by the image capturing means from one side close to the vehicle to the other side remote from the vehicle for detection of an obstacle through pattern matching. Therefore, the system is able to detect an obstacle located close to the vehicle and having a high possibility of colliding with the vehicle, within a short period of time.

In this case, the detecting means may scan the image captured by the image capturing means from the right-hand side when the vehicle runs on a road in a right-hand traffic region.

With the above arrangement, when the vehicle runs on a road in a right-hand traffic region, the image captured by the image capturing means is scanned from the right-hand side, namely, from the side on which a sidewalk may adjoin the right-hand traffic road and pedestrians are likely to be present on the sidewalk or road, so that the pedestrians, if any, can be detected in a reduced time.

The vehicle-installed obstacle detecting system may further include road information acquiring means for acquiring road information about a road on which the vehicle runs, and the detecting means may change the direction of scanning of the image captured by the image capturing means, based on the road information acquired by the road information acquiring means.

With the above arrangement, the system further includes the road information acquiring means for acquiring information on the road on which the vehicle runs, and the detecting means changes the direction of scanning of the image captured by the image capturing means, based on the road information acquired by the road information acquiring means. Therefore, the scanning direction may be changed so that the image is scanned from the left-hand side on which a sidewalk may be located if the vehicle runs on a road in a left-hand traffic region, and the image is scanned from the right-hand side on which a sidewalk may be located if the vehicle runs on a road in a right-hand traffic region.

The image capturing means may capture the image of the surroundings frame by frame, and the detecting means may cancel scanning of a frame image captured by the image capturing means when the number of detected obstacles reaches a specified number that is set to a smaller value as the vehicle speed is higher, and proceeds to scan another frame image captured by the image capturing means.

With the above arrangement, the detecting means cancels scanning of a certain frame image captured by the image capturing means when the number of detected obstacles reaches the specified number that is set to a smaller value as the vehicle speed is higher, and proceeds to scan another frame image captured by the image capturing means. Therefore, when the vehicle runs at a high speed, scanning of a place close to the vehicle for detection of obstacles is performed with an increased frequency or at shorter intervals, and an obstacle having a high possibility of colliding with the vehicle during high-speed running can be detected in a shorter time.

According to a second aspect of the invention, there is provided an obstacle detecting method of detecting an obstacle in surroundings of a vehicle, characterized by including the steps of capturing an image of the surroundings of the vehicle, and scanning the captured image from one side of the image close to the vehicle toward the other side thereof remote from the vehicle, for detection of an obstacle through pattern matching.

In the detecting method according to the second aspect of the invention, the image captured by the image capturing means is scanned from one side close to the vehicle to the other side remote from the vehicle for detection of an obstacle through pattern matching. Therefore, the system is able to detect an obstacle located close to the vehicle and having a high possibility of colliding with the vehicle, within a short period of time.

According to the invention, an obstacle having a high possibility of colliding with the vehicle can be detected in a reduced time.

BRIEF DESCRIPTION OF THE DRAWINGS

The foregoing and further features and advantages of the invention will become apparent from the following description of exemplary embodiments with reference to the accompanying drawings, wherein like numerals are used to represent like elements, and wherein:

FIG. 2 is a view showing an example of running condition table;

FIG. 3 is a flowchart illustrating the operation of the vehicle-installed obstacle detecting system of the first embodiment;

FIG. 9 is a view showing an example of search canceling number table; and

DETAILED DESCRIPTION OF EMBODIMENTS

Vehicle-installed obstacle detecting systems according to some embodiments of the invention will be described with reference to the accompanying drawings.

Figure 1:
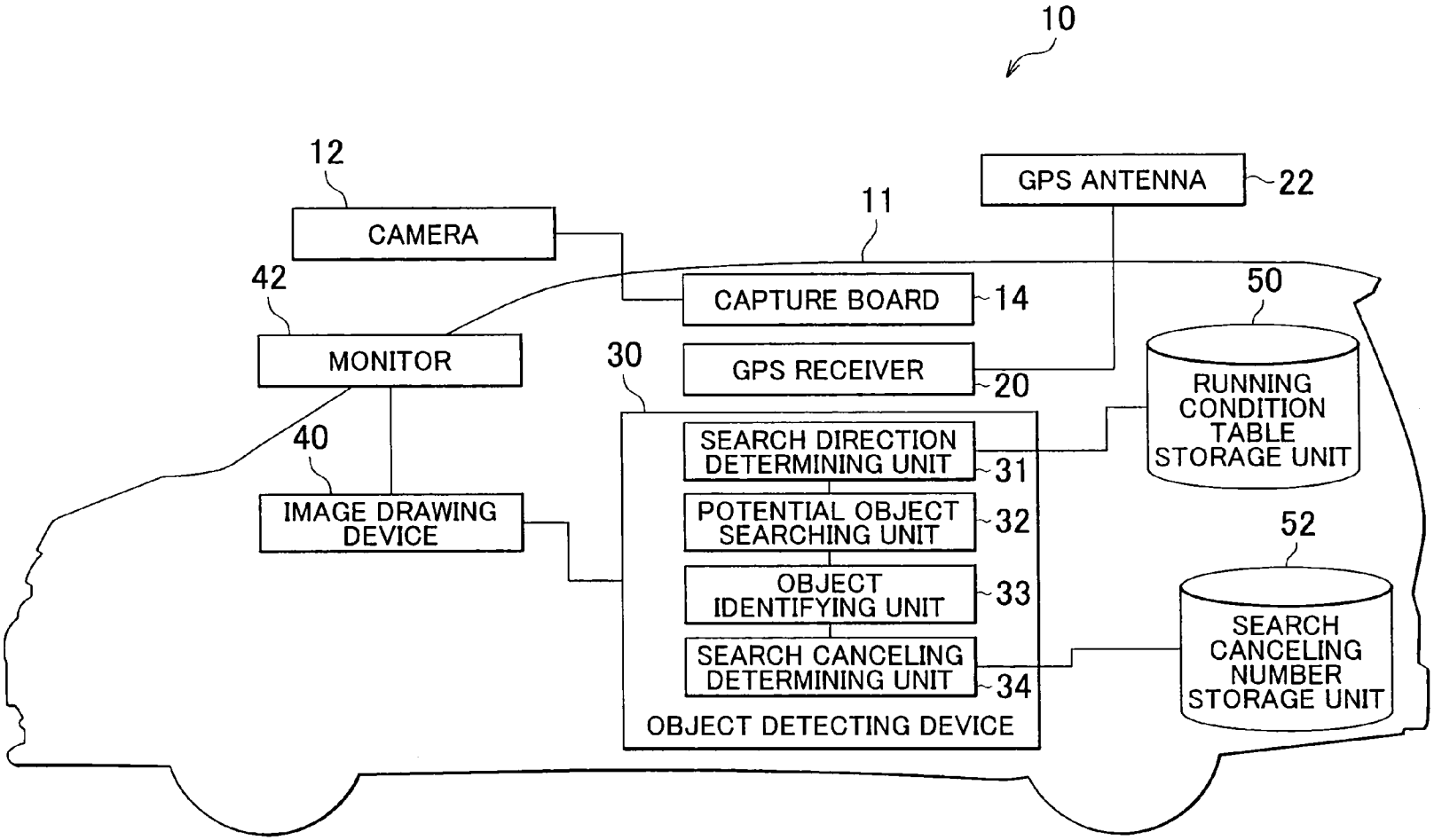
FIG. 1 is a block diagram showing the construction of a vehicle-installed obstacle detecting system according to a first embodiment of the invention.

FIG. 1 is a block diagram showing the construction of a vehicle-installed obstacle detecting system according to a first embodiment of the invention. The vehicle-installed obstacle detecting system of this embodiment is arranged to detect obstacles, such as pedestrians, which may collide with the vehicle during running of the vehicle, and draw the attention of the vehicle driver to the obstacles. As shown in FIG. 1, the vehicle-installed obstacle detecting system 10 of this embodiment includes a camera (image capturing means) 12, capture board 14, GPS receiver (road information acquiring means) 20, GPS antenna 22, object detecting device (detecting means) 30, image drawing device 40, monitor 42, running condition table storage unit 50, and a search canceling number storage unit 52 for storing the number of objects based on which searching is cancelled. All of these devices and units are mounted in a vehicle body 11.

The camera 12 is in the form of a monocular camera or a stereo camera using semiconductor devices, such as CCD or CMOS, and is operable to acquire or capture an image ahead of the vehicle body 11 frame by frame at intervals of 10 to 100 ms. If it is deemed important to detect pedestrians, or the like, at night, a near infrared camera or a far infrared camera having excellent night-vision performance may be employed as the camera 12. The frame images acquired by the camera 12 are transmitted to the capture board 14, and are converted into data format so that the image data can be processed by the object detecting device 30.

The GPS receiver 20 receives radio waves transmitted from a satellite via a GPS antenna 22, and detects the current position of the vehicle based on the radio-wave information, so as to acquire information relating to the road on which the own vehicle is currently running. As a means for acquiring the information on the road on which the own vehicle is running, other devices may be used instead of the GPS receiver 20. For example, a magnetic sensor for detecting magnetic markers embedded at given intervals along road surfaces may be used.

The object detecting device 30 is configured using hardware and software of a microcomputer, such as an ECU (Electric Control Unit), and is arranged to scan the frame images captured by the camera 12 for detection of obstacles through a process of pattern matching. The object detecting device 30 includes a search direction determining unit 31, a potential object searching unit 32, an object identifying unit 33, and a search canceling determining unit 34.

The search direction determining unit 31 determines the scanning direction in which an obstacle is searched for, based on the road information retrieved from the GPS receiver 20 and running conditions retrieved from the running condition table storage unit 50. FIG. 2 shows an example of running condition table. As shown in FIG. 2, the running condition table storage unit 50 stores the current latitude and longitude of the own vehicle, the country in which the own vehicle is currently running, and the traveling or running direction in which traffic travels on roads in the country, such that these pieces of information are associated with one another. For example, the running direction in Japan is stored as "left-hand traffic", and the running direction in the U.S. is stored as "right-hand traffic", in the running condition table storage unit 50.

Referring back to FIG. 1, the potential object searching unit 32 extracts potential objects by scanning the frame images acquired by the camera 12 in the scanning direction determined by the search direction determining unit 31. The object identifying unit 33 sequentially performs a process of pattern matching each time the potential object searching unit 32 extracts one potential object, and determines whether the potential object is an object, such as a pedestrian, of which a warning should be given to the driver.

The search canceling determining unit 34 causes the potential object searching unit 32 to cancel or terminate scanning of the frame image, based on the number of objects set for canceling the current search, which is retrieved from the search canceling number storage unit 52. For example, the search canceling number storage unit 52 stores information to the effect that the potential object searching unit 32 should cancel scanning if the object identifying unit 33 identifies three objects (obstacles). The information stored in the storage unit 52 may be changed based on the road information. For example, the number of objects set for canceling searching may be set to a large number when the vehicle runs on a street or road on or around which a large number of pedestrians are present, and may be set to a small number when the vehicle runs on an expressway or a highway on or around which a small number of pedestrians are present.

The image drawing device 40 performs a process of superimposing a detection image in which an image of each detected object is highlighted, for example, is displayed with a box indicative of the presence of a pedestrian, based on the object-related information generated from the object detecting device 30, on the corresponding frame image received from the camera 12, and outputs the resulting image to the monitor 42. The monitor 42 serves to present the image containing the box or boxes indicating the pedestrian(s), or the like, to the driver. Generally, a liquid crystal monitor or a monitor for a navigation system may be employed as the monitor 42.

Referring next to FIG. 3, the operation of the vehicle-installed obstacle detecting system 10 of this embodiment will be explained. FIG. 3 is a flowchart illustrating the operation of the vehicle-installed obstacle detecting system 10 according to the first embodiment of the invention. As shown in FIG. 3, the vehicle-installed obstacle detecting system 10 acquires an image from the camera 12 (S10), and receives the absolute position of the own vehicle via the GPS receiver 20 (S12).

The search direction determining unit 31 of the object detecting device 30 checks the absolute position of the own vehicle received from the GPS receiver 20 against the running condition table stored in the running condition table storage unit 50, and determines the running environment (a right-hand traffic region or a left-hand traffic region) in which the own vehicle is running (S14). The search direction determining unit 31 also determines the search direction in which objects are searched for, based on the determined running environment (S16). In this embodiment, the frame image is scanned from the right-hand side when the own vehicle is running on a road in a right-hand traffic region, and is scanned from the left-hand side when the own vehicle is running on a road in a left-hand traffic region.

Figure 4:
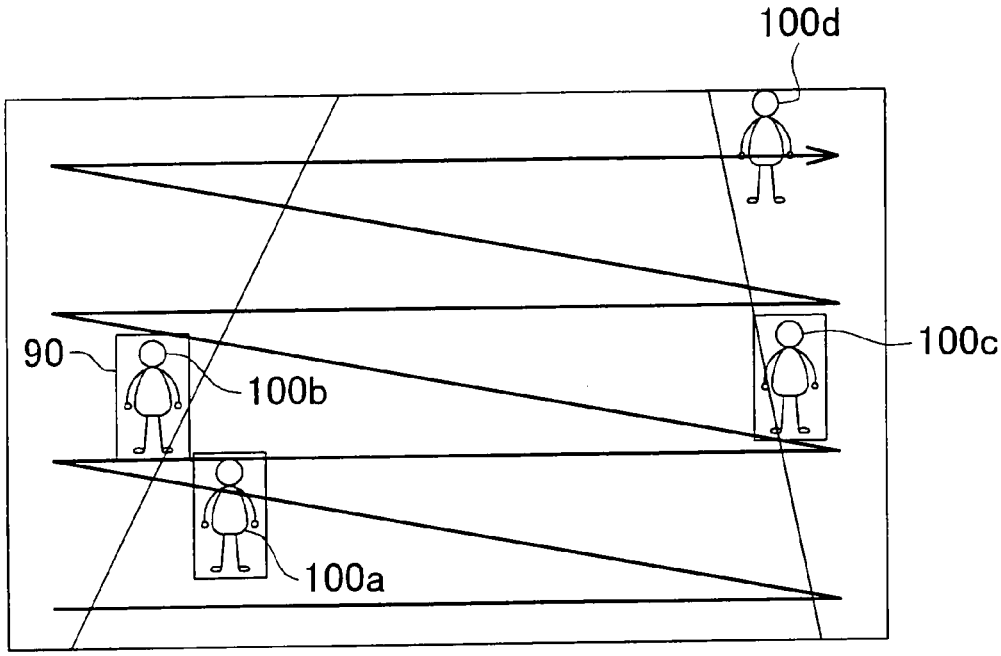
FIG. 4 is a view useful for explaining scanning of an image for detection of obstacles in a left-hand traffic environment.
Figure 5:
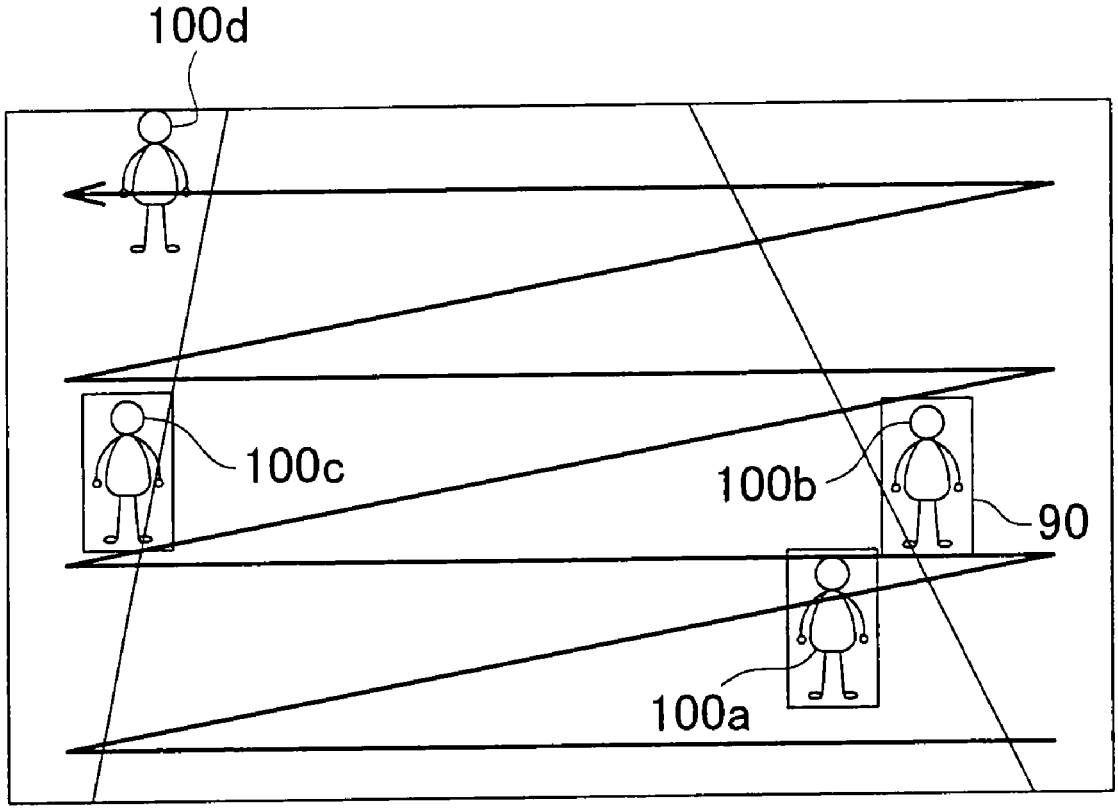
FIG. 5 is a view useful for explaining scanning of an image for detection of obstacles in a right-hand traffic environment.

The potential object searching unit 32 of the object detecting device 30 starts scanning in the search direction determined by the search direction determining unit 31 (S18). As shown in FIG. 4 and FIG. 5, in this embodiment, the frame image is scanned from a lower part of the image toward an upper part thereof as viewed in FIGS. 4 and 5, namely, from one side close to the vehicle body 11 toward the other side remote from the vehicle body 11. In the case where the own vehicle is running on a road in a left-hand traffic region, as shown in FIG. 4, scanning is effected from the left, lower end of the frame image to the right, lower end. Once scanning to the right, lower end is finished, scanning continues to be effected to the upper left in the frame image. Once scanning to the left end of the frame image is finished, scanning continues to be effected to the upper right in the frame image. In the case where the own vehicle is running on a road in a left-hand traffic region, as shown in FIG. 5, scanning is effected from the right, lower end of the frame image to the left, lower end. Once scanning to the left, lower end is finished, scanning continues to be effected to the upper right in the frame image. Once scanning to the right end of the frame image is finished, scanning continues to be effected to the upper left in the frame image.

The potential object searching unit 32 extracts a single potential object (S20). If the searching unit 32 succeeds in extracting the potential object, the control proceeds to subsequent step (S22). If the searching unit 32 fails to extract a potential object, i.e., if a negative decision (NO) is obtained in step S22, the searching unit 32 continues scanning a search region of the frame image to the last point thereof, so as to search for the next potential object (S38, S40).

The object identifying unit 33 of the object detecting device 30 determines through pattern matching whether the extracted potential object is an object to be searched for (S24). If the object identifying unit 33 identifies the potential object as the object, the number of detected objects is incremented, i.e., is increased by one. If the object identifying unit 33 does not identify the potential object as the object, scanning of the frame image is continued (S26, S38).

The search canceling determining unit 34 of the object detecting device 30 causes the potential object searching unit 32 to cancel searching for objects when the number of items determined as objects in the frame image reaches the number of objects set for canceling searching and stored in the search canceling number storage unit 52 (S32). In the examples of FIG. 4 and FIG. 5, for example, a search for objects is cancelled at a point in time at which three objects, out of objects 100*a*, 100*b*, 100*c*, 100*d*, are determined as objects to be highlighted or displayed with surrounding boxes 90. If the number of objects has not reached the number set for canceling the search, scanning of the frame image is continued until the search region of the frame image is searched to the last point (S38).

The image drawing device 40 performs image processing for highlighting the object(s), on the frame image, and makes the presence of the object(s) clear by superimposing the highlighted object(s) on the frame image (S34). The monitor 42 outputs an image in which the position of each object is clearly indicated or highlighted, and presents the image to the driver (S36). Then, the control returns to step S10 to acquire the next frame image.

In a system of the related art, a captured image is scanned from the upper side (remote from the vehicle) to the lower side (close to the vehicle) on the image, and therefore, detection of an obstacle that is close to the vehicle and has a high possibility of colliding with the vehicle after a short time may be delayed. In the present embodiment, the object detecting device 30 scans an image captured by the camera 12 from one side of the image close to the vehicle toward the other side remote from the vehicle, for detection of an obstacle through the process of pattern matching, and is thus able to detect an obstacle that is close to the vehicle and has a high possibility of colliding with the vehicle, in a short time. Thus, the obstacle detecting system 10 of this embodiment can inform the vehicle driver of the presence of an obstacle having a high risk of collision, earlier than other obstacles located ahead of the vehicle.

In the present embodiment, when the vehicle runs on a road in a right-hand traffic region, an image captured by the camera 12 is scanned from the right-hand side, namely, from the side on which a sidewalk may adjoin the right-hand traffic road and pedestrians are more likely to be present. Thus, the obstacle detecting system of this embodiment is able to detect a pedestrian(s) in a shorter time than in the case where the image is scanned from the left-hand side.

Also, in this embodiment, the object detecting device 30 changes the direction of scanning of the frame image captured by the camera 12, based on the road information received from the GPS receiver 20 and the running condition table storage unit 50. Therefore, the object detecting device 30 can change the scanning direction so that the frame image is scanned from the left-hand side on which a sidewalk is located when the vehicle runs on a road in a left-hand traffic region, and the frame image is scanned from the right-hand side on which a sidewalk is located when the vehicle runs on a road in a right-hand traffic region.

Figure 6:
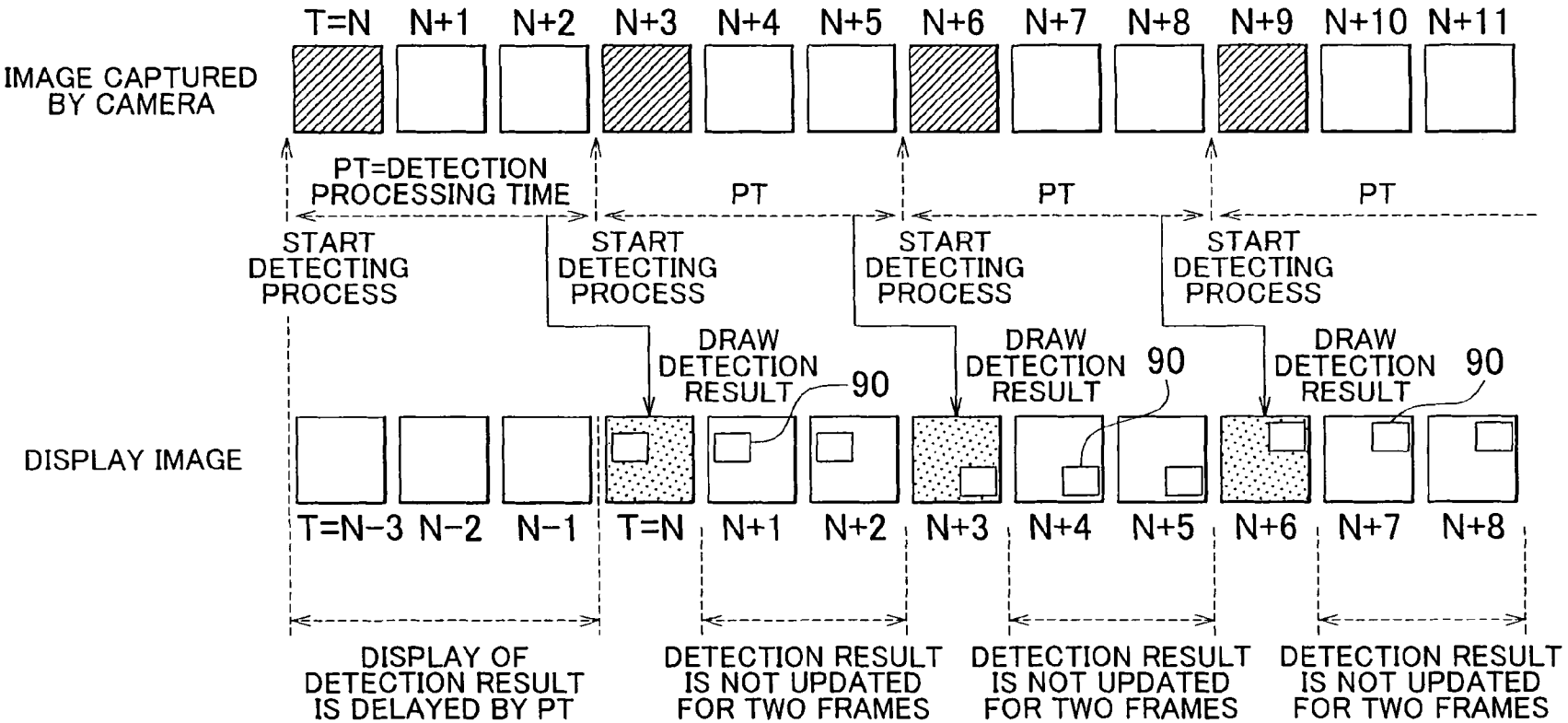
FIG. 6 RELATED ART
FIG. 6 is a view showing the relationship between images captured by a camera and display images in a system of the related art.
Figure 7:
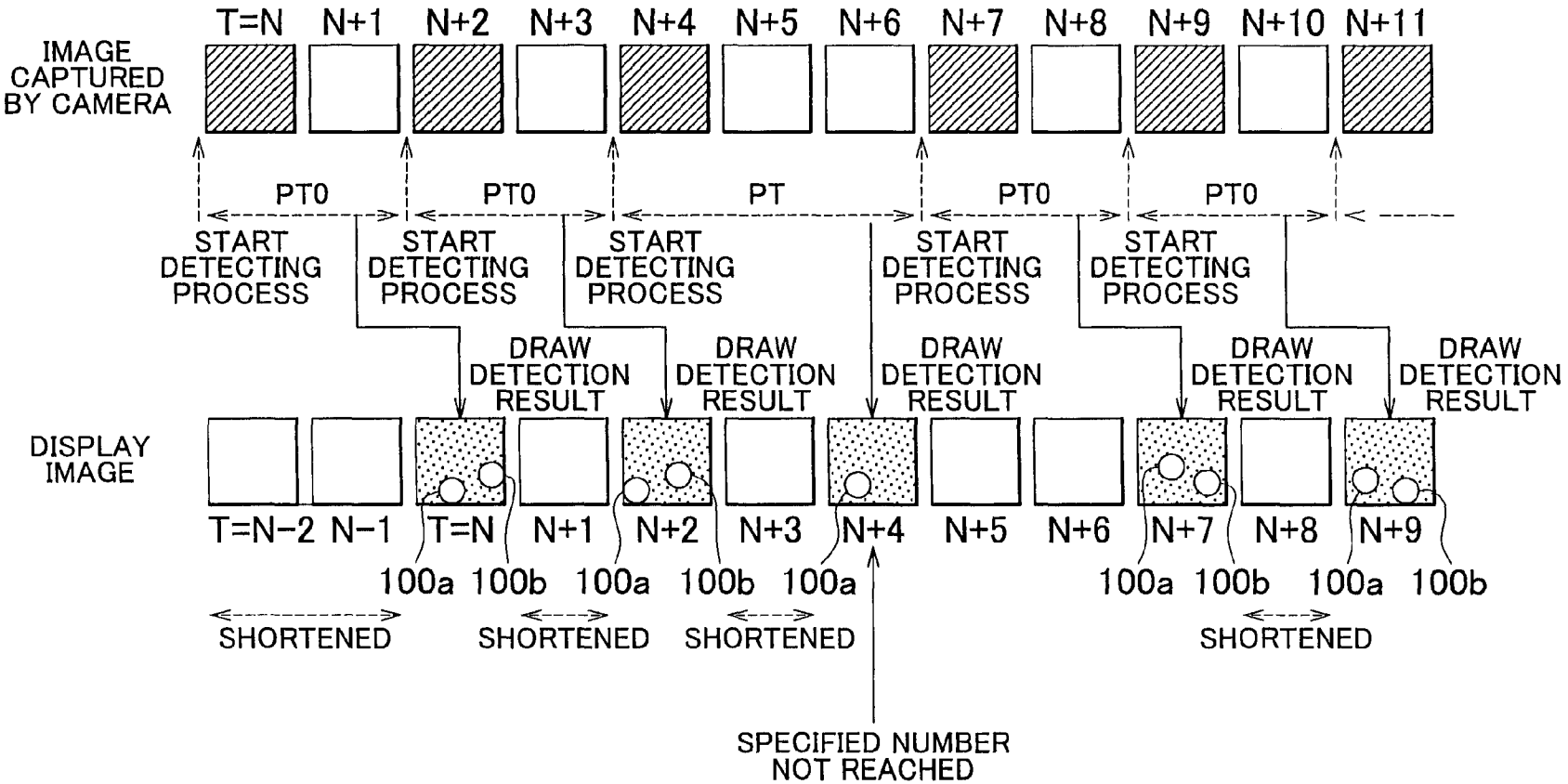
FIG. 7 is a view showing the relationship between images captured by a camera and display images in the system of the first embodiment.

Furthermore, in this embodiment, the object detecting device 30 cancels or stops scanning of a certain frame image captured by the camera 12, at a point in time at which the number of detected objects reaches the number set for canceling searching and stored in the search canceling number storage unit 52, and proceeds to scan another frame image captured by the camera 12. Thus, the detecting process is speeded up, in other words, the detecting process is executed at shortened intervals. In the related art as shown in FIG. 6, while the result of detection is displayed with the detected obstacle highlighted with the surrounding box 90, display of the result of detection is inevitably delayed by detection processing time PT, and therefore, the display is not updated with respect to the number of frames corresponding to the detection processing time PT. In the present embodiment, on the other hand, the image captured by the camera 12 is scanned from the side close to the vehicle, i.e., the side on which an obstacle is more likely to be present, and scanning of a certain image is cancelled or stopped when the number of detected objects reaches the number set for canceling searching, as shown in FIG. 7. Therefore, the time required for updating display of the result of detection of, for example, objects 100*a*, 100*b* can be reduced. Thus, the obstacle detecting system of this embodiment is able to more promptly inform the driver of the presence of an obstacle or obstacles in real time.

Figure 8:
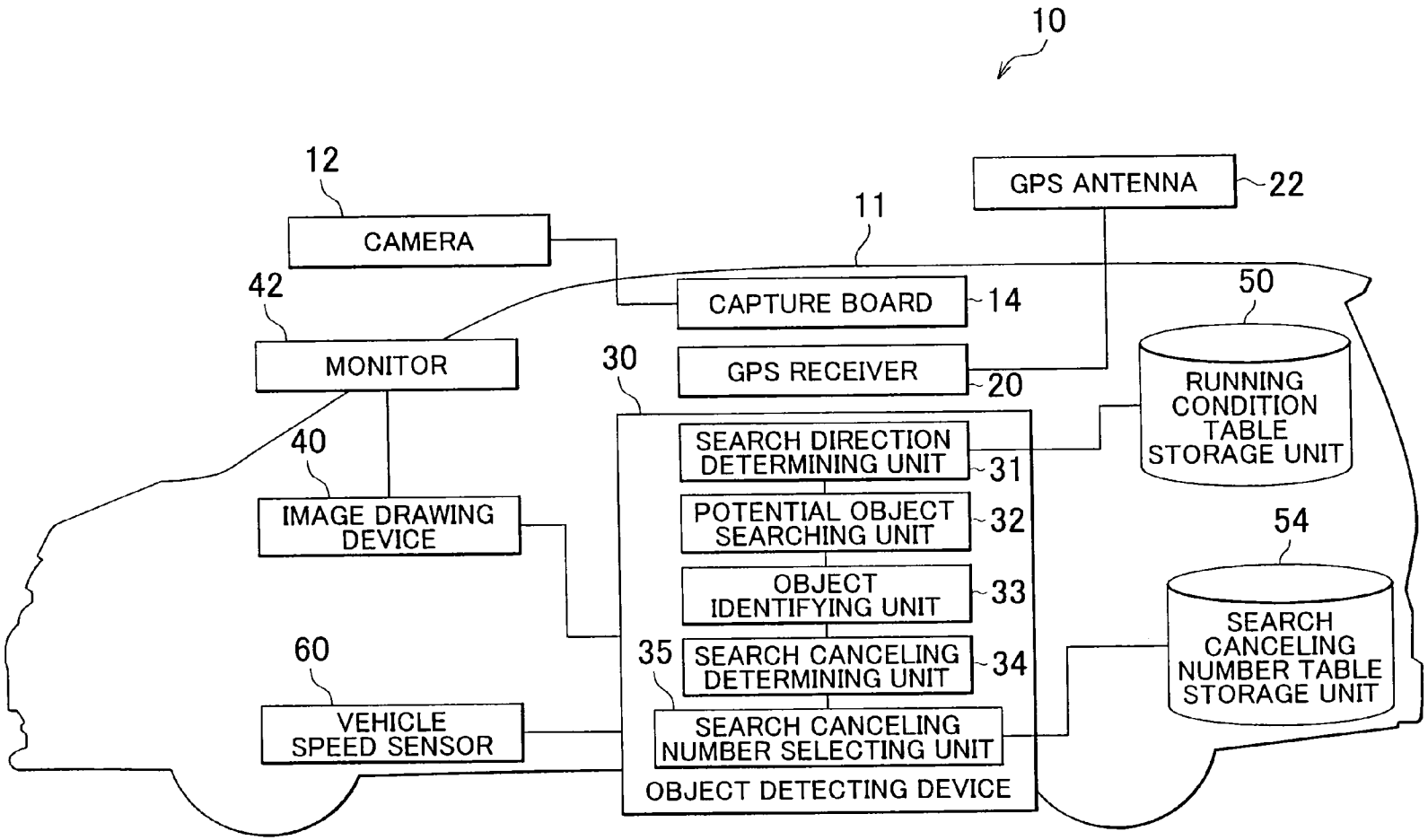
FIG. 8 is a block diagram showing the construction of a vehicle-installed obstacle detecting system according to a second embodiment of the invention.

In the following, a second embodiment of the invention will be described. FIG. 8 is a block diagram showing the construction of a vehicle-installed obstacle detecting system of the second embodiment. As shown in FIG. 8, the vehicle-installed obstacle detecting system 10 of this embodiment is different from that of the above-described first embodiment in that the object detecting device 30 includes a search canceling number selecting unit 35, and that a search canceling number table storage unit 54 is connected to the search canceling number selecting unit 35.

FIG. 9 shows an example of search canceling number table of this embodiment. As shown in FIG. 9, the vehicle speed and a specified number as the number of objects set for canceling searching are associated with each other and stored in the search canceling number table. As shown in FIG. 9, the higher the vehicle speed is, the smaller value the specified number is set to. Referring again FIG. 8, the search canceling number selecting unit 35 determines the number of objects set for canceling searching, based on the vehicle speed of the own vehicle and the specified number indicated in the search canceling number table.

Figure 10:
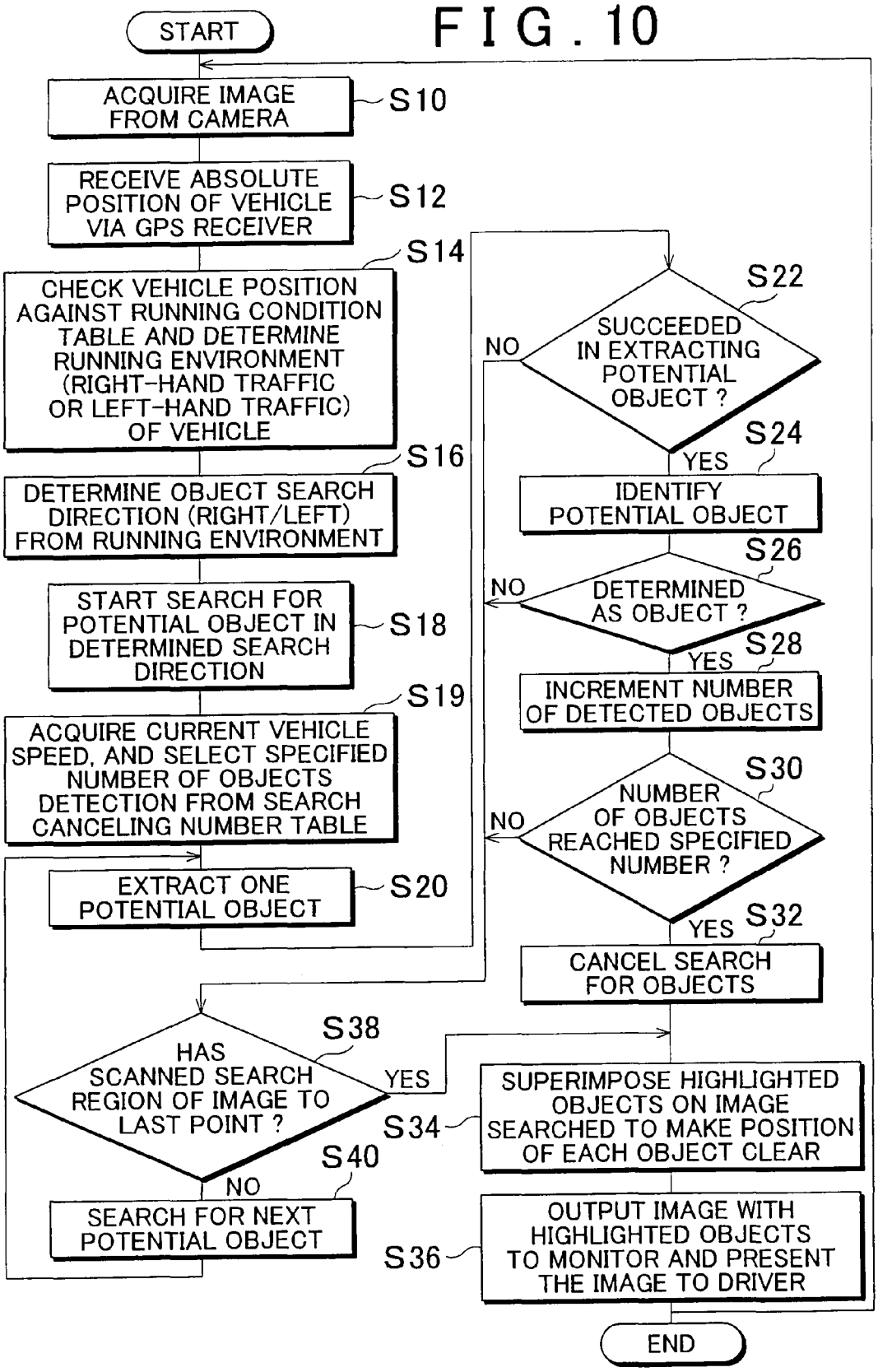
FIG. 10 is a flowchart illustrating the operation of the vehicle-installed obstacle detecting system of the second embodiment.

FIG. 10 is a flowchart illustrating the operation of the vehicle-installed obstacle detecting system according to the second embodiment of the invention. The operation of the system of this embodiment is different from that of the first embodiment in that the search canceling number selecting unit 35 selects the specified number based on which searching for objects is cancelled, based on the current vehicle speed and the search canceling number table stored in the storage unit 54, between step S18 for starting a search for a potential object and step S20 for extracting a potential object. In step S30, the current search for objects is cancelled when the number of objects reaches the specified number.

In the present embodiment, the object detecting device 30 cancels or stops scanning of a certain frame image captured by the camera 12, at a point in time at which the number of detected obstacles reaches the specified number that is set to a smaller value as the vehicle speed is higher, and then proceeds to scan another frame image captured by the image capturing means (i.e., the camera 12). Thus, when the vehicle runs at a high speed, scanning of a place close to the vehicle for detection of obstacles is performed with an increased frequency or at shorter intervals, and an obstacle having a high possibility of colliding with the vehicle during high-speed running can be detected in a shorter time.

While the invention has been described with reference to exemplary embodiments thereof, it is to be understood that the invention is not limited to the described embodiments or constructions. To the contrary, the invention is intended to cover various modifications and equivalent arrangements. In addition, while the various elements of the exemplary embodiments are shown in various combinations and configurations, other combinations and configurations, including more, less or only a single element, are also within the spirit and scope of the invention.

The invention claimed is:

1. An obstacle detecting method of detecting an obstacle in surroundings of a vehicle, comprising:

capturing an image of the surroundings of the vehicle; and scanning the captured image from one side of the captured image that is close to the vehicle toward an other side of the captured image that is remote from the vehicle, for detecting an obstacle through pattern matching, wherein the scanning scans the captured image from a right-hand side of the vehicle when the vehicle runs on a road in a right-hand traffic region.

2. A vehicle-installed obstacle detecting system for detecting an obstacle in surroundings of a vehicle, comprising:

an image capturing portion that captures an image of the surroundings of the vehicle; and a detecting portion that scans the image captured by the image capturing portion from one side of the captured image that is close to the vehicle toward an other side of the captured image that is remote from the vehicle, for detecting an obstacle through pattern matching; wherein the detecting portion scans the image captured by the image capturing portion from a right-hand side of the vehicle when the vehicle runs on a road in a right-hand traffic region.

3. The obstacle detecting method according to claim 1, wherein:

in the scanning, a direction of the scanning changes so that the captured image is scanned from a left-hand side of the vehicle if the vehicle runs on a road in a left-hand traffic region.

4. The vehicle-installed obstacle detecting system according to claim 2, wherein:

the detecting portion changes the direction of the scanning so that the image captured by the image capturing portion is scanned from a left-hand side of the vehicle if the vehicle runs on a road in a left-hand traffic region.

5. The obstacle detecting method according to claim 1, wherein:

the image of the surroundings of the vehicle is captured frame by frame; and the scanning of a captured frame image is canceled when a number of detected obstacles reaches a specified number, and proceeds to scan another captured frame image, the specified number being set to a smaller value as a speed of the vehicle increases.

6. The vehicle-installed obstacle detecting system according to claim 2, wherein:

the image capturing portion captures the image of the surroundings of the vehicle frame by frame; and the detecting portion cancels the scanning of a frame image captured by the image capturing portion when a number of detected obstacles reaches a specified number, and proceeds to scan another frame image captured by the image capturing portion, the specified number being set to a smaller value as a speed of the vehicle increases.

7. The obstacle detecting method according to claim 3, wherein:

the image of the surroundings of the vehicle is captured frame by frame; and the scanning of a captured frame image is canceled when a number of detected obstacles reaches a specified number, and proceeds to scan another captured frame image, the specified number being set to a smaller value as a speed of the vehicle increases.

8. The vehicle-installed obstacle detecting system according to claim 4, wherein:

the image capturing portion captures the image of the surroundings of the vehicle frame by frame; and the detecting portion cancels the scanning of a frame image captured by the image capturing portion when a number of detected obstacles reaches a specified number, and proceeds to scan another frame image captured by the image capturing portion, the specified number being set to a smaller value as a speed of the vehicle increases.

9. The obstacle detecting method according to claim 1, further comprising:

acquiring road information about a road on which the vehicle runs, and changing a direction of scanning of the captured image, based on the acquired road information.

10. The vehicle-installed obstacle detecting system according to claim 2, further comprising:

a road information acquiring portion that acquires road information about a road on which the vehicle runs, wherein the detecting portion changes the direction of scanning of the image captured by the image capturing portion, based on the road information acquired by the road information acquiring portion.

* * * * *